US008936688B2

(12) United States Patent
Horikawa et al.

(10) Patent No.: US 8,936,688 B2
(45) Date of Patent: Jan. 20, 2015

(54) ALUMINUM ALLOY CASTING MATERIAL FOR HEAT TREATMENT EXCELLING IN HEAT CONDUCTION AND PROCESS FOR PRODUCING THE SAME

(75) Inventors: Hiroshi Horikawa, Ihara-gun (JP); Sanji Kitaoka, Shinagawa-ku (JP); Masahiko Shioda, Shinagawa-ku (JP); Toshihiro Suzuki, Ihara-gun (JP); Takahiko Watai, Ihara-gun (JP); Hidetoshi Kawada, Ihara-gun (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 0 days.

(21) Appl. No.: 13/342,625

(22) Filed: Jan. 3, 2012

(65) Prior Publication Data

US 2012/0168041 A1 Jul. 5, 2012

Related U.S. Application Data

(62) Division of application No. 11/547,257, filed as application No. PCT/JP2005/006639 on Apr. 5, 2005, now abandoned.

(30) Foreign Application Priority Data

Apr. 5, 2004 (JP) ..... 2004-111496
Apr. 7, 2004 (JP) ..... 2004-113584

(51) Int. Cl.
*C22F 1/043* (2006.01)

(52) U.S. Cl.
USPC ..... 148/698; 148/549; 148/702

(58) Field of Classification Search
USPC ..... 148/549, 698, 702
See application file for complete search history.

(56) References Cited

U.S. PATENT DOCUMENTS

| | | | | |
|---|---|---|---|---|
| 2001/0008155 | A1 | 7/2001 | Hashimoto et al. | |
| 2004/0045638 | A1 * | 3/2004 | Garat et al. | 148/417 |
| 2005/0191204 | A1 * | 9/2005 | Lin et al. | 420/531 |
| 2006/0021683 | A1 * | 2/2006 | Lin et al. | 148/549 |

FOREIGN PATENT DOCUMENTS

| | | |
|---|---|---|
| DE | 42 15 160 | 11/1993 |
| DE | 42 15 160 A1 | 11/1993 |
| JP | 59 193237 | 11/1984 |
| JP | 59193237 A * | 11/1984 |

(Continued)

OTHER PUBLICATIONS

'Aluminum and Aluminum Alloys', ASM International, 1993, p. 98-99.*

(Continued)

*Primary Examiner* — Roy King
*Assistant Examiner* — Janelle Morillo
(74) *Attorney, Agent, or Firm* — Oblon, Spivak, McClelland, Maier & Neustadt, L.L.P.

(57) ABSTRACT

An aluminum alloy casting material for heat conducting is provided, wherein the thermal conductivity is improved of an aluminum alloy casting material whereof the castability is improved by the addition of silicon where said invention is characterized by being an aluminum alloy casting material with excellent thermal conductivity, comprising 5-10.0% by mass of silicon, 0.1-0.5% by mass of magnesium and the remainder comprising aluminum and inevitable impurities, and whereon aging treatment has been performed.

3 Claims, 1 Drawing Sheet

State of crystallized products in AC4CH as-cast material and heat-treated material

(56) References Cited

FOREIGN PATENT DOCUMENTS

| | | | |
|---|---|---|---|
| JP | 9-41064 | A | 2/1997 |
| JP | 2000-192180 | A | 7/2000 |
| JP | 2001 200325 | | 7/2001 |
| JP | 2001 316748 | | 11/2001 |
| JP | 2002 105571 | | 4/2002 |
| JP | 2003 89838 | | 3/2003 |
| JP | 2003 239031 | | 8/2003 |

OTHER PUBLICATIONS

Aluminium Rheinfelden: Hüttenaluminium Gusslegierungen, 1994, pp. 12-72, XP002457020, Castrop-Rauxel, the whole document.
"Huettenaluminium Gusslegierungen", Announcement Aluminium Rheinfelden, XX, XX, XP009082093, vol. V.6.3, Jan. 1, 2003, 88 pages.
Aluminium Rheinfelden: Hüttenaluminium Gusslegierungen, 1994, pp. 65 and 76.

* cited by examiner

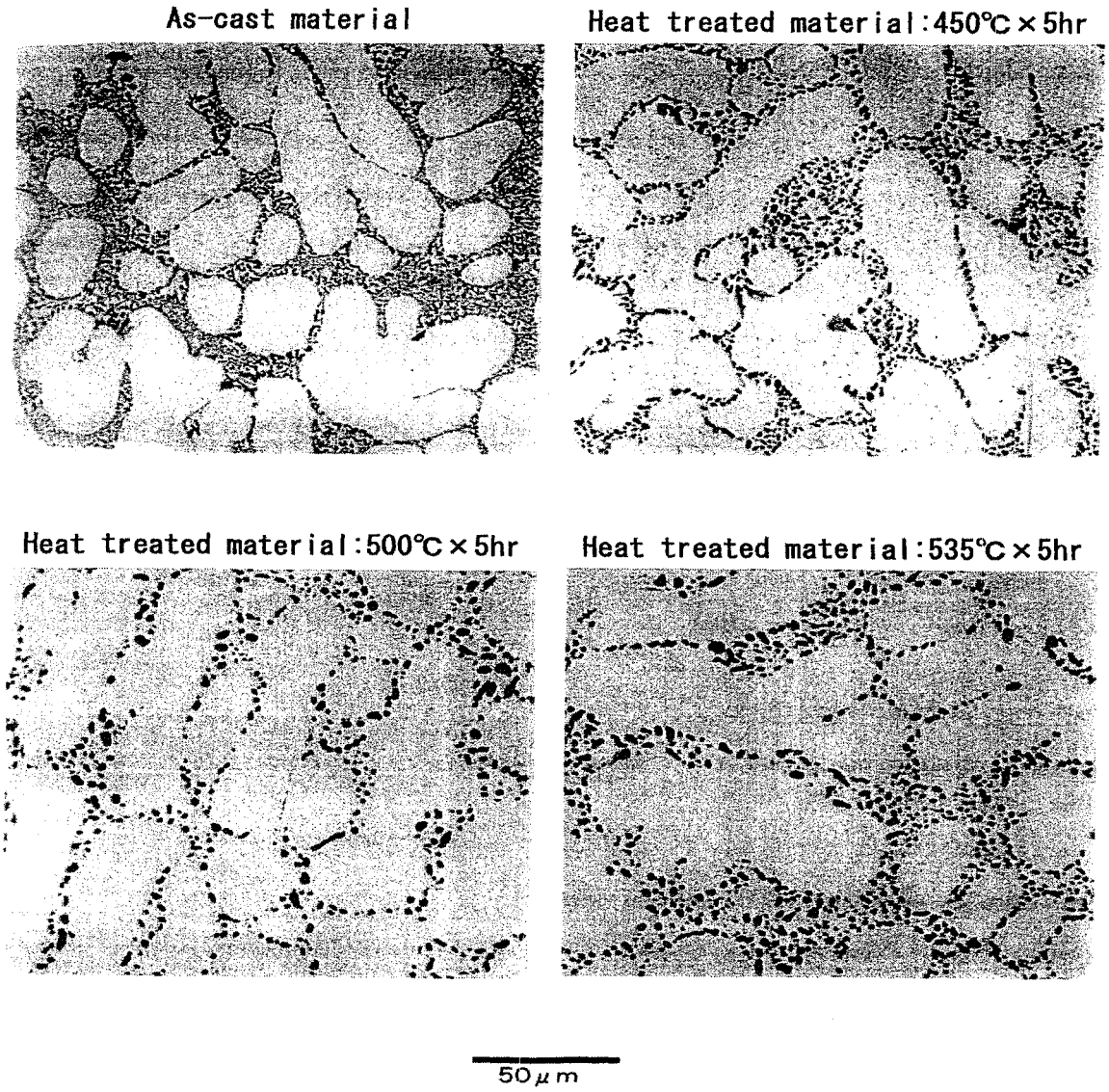
State of crystallized products in AC4CH as-cast material and heat-treated material

ALUMINUM ALLOY CASTING MATERIAL FOR HEAT TREATMENT EXCELLING IN HEAT CONDUCTION AND PROCESS FOR PRODUCING THE SAME

CROSS-REFERENCE TO RELATED APPLICATIONS

This application is a divisional application of U.S. application Ser. No. 11/547,257 filed on Sept. 28, 2007, abandoned, which is a 371 of PCT/JP05/06639 filed Apr. 5, 2005 and claims the benefit of Japanese patent application no. 2004-111496 filed Apr. 5, 2004 and of Japanese patent application no. 2004-1113584 filed Apr. 7, 2004, the contents of which are incorporated herein by reference.

TECHNICAL FIELD

The present invention concerns an aluminum alloy casting material having a high thermal conductivity and a manufacturing methods thereof. The aluminum alloy casting material having a high thermal conductivity according to the present invention may be used optimally for heatsinks having a complex shape in order to increase heat radiation, and heatsinks having a thin-walled portion and the like.

BACKGROUND ART

For aluminum alloys in general, the thermal conductivity increases as the aluminum content of the alloy gets higher. Therefore, in cases where a high thermal conductivity is necessary, the use of pure aluminum may be considered, but pure aluminum has the problems of low strength and low castability, so it was not possible to cast things having complex shapes and thin-walled portions.

Accordingly, in cases where heatsinks having a complex shape were manufactured, for example, as described in Japanese Unexamined Patent Publication No. 2001-316748, Japanese Unexamined Patent Publication No. 2002-3972, and Japanese Unexamined Patent Publication No. 2002-105571, aluminum alloys with silicon added were used in order to improve castability, even at the expense of a certain degree of thermal conductivity.

However, along with the increase in performance of electronic devices in recent years, heatsinks with higher performance have come to be sought. Accordingly, the development of alloys having better thermal conductivity than conventional aluminum alloy castings has been awaited.

DISCLOSURE OF THE INVENTION

Problems to be Solved by the Invention

In order to solve the problems such as those described above of the conventional art, the present invention has the objective of an aluminum alloy casting material for heat treatment wherefor castability is improved by adding silicon, and at the same time having improved thermal conductivity.

Additionally, the present invention has the objective of providing a method for manufacturing said aluminum alloy casting material.

Means for Solving the Problems

The aluminum alloy casting material according to claims 1 offered by the present invention in order to solve the abovementioned problems is an aluminum alloy casting material with excellent thermal conductivity, characterized by containing 5-10.0% by mass of silicon, 0.1-0.5% by mass of magnesium, the remainder comprising aluminum and inevitable impurities, whereon aging treatment has been performed.

According to claim 2 of the present application, the abovementioned aluminum alloy casting material may further contain 0.3-0.6% by mass of iron.

The aluminum alloy casting materials having such compositions are, as shall be described herebelow giving embodiments, aluminum alloy casting materials having excellent castability in addition to high thermal conductivity and strength.

According to claim 3 of the present application, for the aging treatment, holding in a temperature of 160-270 degrees Celsius for 1-10 hours is suggested.

Additionally, the present invention according to claim 4 suggests performing solution heat treatment by holding at 480-540 degrees Celsius for 1-10 hours before performing aging treatment, and subsequently, quenching by cooling to a temperature of 100 degrees Celsius or below at a cooling rate of 100 degrees Celsius per second or faster.

As described in the embodiments given, it was discovered that by performing the aging treatment and solution heat treatment described above, the thermal conductivity characteristics and mechanical strength of the abovementioned aluminum alloy casting materials improve further.

The inventors of the present invention, as a result of keen research in order to solve the abovementioned problems, found that the amount of silicon in solid solution within the matrix of an aluminum-silicon aluminum alloy casting, and the area ratio of crystallized products within the metal structure, affect the thermal conductivity and strength of the casting greatly, and by optimizing the values of the amount of silicon in solid solution and the area ratio of the crystallized products in the metal structure, an aluminum alloy casting with particularly excellent thermal conductivity, while having sufficient mechanical strength, is obtainable.

Additionally, it was discovered that the amount of silicon in solid solution and the area ratio of the crystallized products could be controlled by heating and holding treatment after casting.

Thus, by the inventions according to claims 5 of the present application, an aluminum alloy casting with excellent thermal conductivity is provided, characterized by containing 6.0-8.0% by mass of silicon, 0.6% by mass or less of any single elements other than silicon and aluminum, the amount of silicon in solid solution within the aluminum matrix being adjusted to 0.5-1.1% by mass, preferably 0.55-1.05% by mass, more preferably 0.6-1.0% by mass, and the area ratio of the crystallized products within the metal structure being adjusted to 5-8%, preferably 5.5-7.5%, more preferably 6.0-7.0%.

Here, according to claim 6 of the present application, the abovementioned aluminum alloy casting has a composition comprising, for elements other than silicon and aluminum, 0.2-0.5% by mass of magnesium, 0.6% by mass or less of iron, and other elements whereof the total amount is 0.2% by mass or less.

Additionally, according to claim 7 of the present application, for the above-mentioned aluminum alloy casting, in cases where titanium and/or zirconium is contained within the abovementioned other elements, it is preferable that the amount of titanium and/or zirconium is adjusted to 0.03% by mass or less.

According to claim 8 of the present application, said aluminum alloy casting has a thermal conductivity better than that of conventional aluminum alloy castings, and has a thermal conductivity of preferably 160 W/(m·k) or greater, more preferably 165 W/(m·k) or greater.

Further, the invention according to claim 9 of the present application provides a manufacturing method for an aluminum alloy casting with excellent thermal conductivity, characterized by containing 6.0-8.0% by mass of silicon, and conducting heating and holding treatment at 400-510 degrees Celsius for 1 hour or longer on an aluminum alloy casting material wherein the amount of any single element other than silicon or aluminum is 0.6% by mass or below.

Here the aluminum alloy casting material preferably contains 6.0-8.0% by mass of silicon, 0.2-0.5% by mass of magnesium, 0.6% by mass or less of iron, the remainder comprising aluminum and other elements whereof the total amount is 0.2% by mass or less, and the titanium and/or zirconium within the aluminum alloy casting material is adjusted to 0.03% by mass or less. The length of time of the heating and holding treatment of the aluminum alloy casting material is 1 hour or longer. However, even if the heating and holding treatment is performed for 7 hours or longer, no further improvement in the characteristics can be obtained, so it is preferable to perform the treatment for 7 hours or less.

Effects of the Invention

It will become possible to optimally manufacture heatsinks having a complex shape, or heatsinks having a thin-walled portion, by taking advantage of the characteristics of the aluminum alloy with excellent castability having excellent thermal conductivity and mechanical strength described above.

BRIEF EXPLANATION OF THE DRAWINGS

FIG. 1 A microphotograph showing the structures of as-cast material and aluminum alloy castings (No. 1, 4-6)

BEST MODES FOR EMBODYING THE INVENTION

Herebelow, the inventions according to claims 1 through 4 of the present application shall be explained.

It was thought that for aluminum-silicon aluminum alloys, magnesium has the effect of improving mechanical strength but lowering thermal conductivity, so that for casting material requiring a high thermal conductivity, it is preferable to reduce the magnesium content as much as possible.

However, the inventors of the present patent application, as a result of having conducted keen research, discovered that in the case of the alloy composition of the present application, by adding magnesium in the range of 0.1-0.5% by mass, if appropriate aging treatment is performed, the amount of silicon in solid solution within the matrix is reduced, and the thermal conductivity improves.

Accordingly, the invention of the present application makes the thermal conductivity of an aluminum alloy casting material higher by adding 0.1-0.5% by mass of magnesium to an aluminum-silicon aluminum alloy.

Herebelow, the effects of each component shall briefly be explained.

(Silicon: 5-10.0% by Mass)

Silicon has the effect of improving castability. In the case of casting of things having a complex shape or a thin-walled portion such as heatsinks, from the viewpoint of castability, it becomes necessary to add 5% by mass or more of silicon. Additionally, silicon also has the effects of improving the mechanical strength, wear resistance, and vibration damping ability of the casting material. However, as the silicon increases, thermal conductivity and extensibility are reduced, and if the amount of silicon exceeds 10% by mass, plastic workability becomes insufficient, so that it is desirable for the silicon content to be 10.0% by mass or less.

(Iron: 0.3-0.6% by Mass)

Iron, in addition to improving the mechanical strength of an aluminum alloy, has the effect of preventing sticking to the die when casting with the diecast method. This effect becomes marked when greater than 0.3% by mass of iron is contained. However, as the amount of iron gets greater, thermal conductivity and extensibility are reduced, so if the amount of iron exceeds 0.6% by mass, plastic workability becomes insufficient.

(Magnesium: 0.1-0.5% by Mass)

During aging treatment, magnesium forms magnesium-silicon compounds with silicon within the matrix and precipitates, reducing the amount of silicon in solid solution within the matrix, and improving thermal conductivity. Further, by the addition of magnesium, the mechanical strength improves. This effect becomes marked when the added amount of magnesium is 0.1% by mass or greater, but when the added amount exceeds 0.5% by mass, the thermal conductivity gets reduced.

(Inevitable Impurities)

Since as the amount of impurities increases, the thermal conductivity is reduced, it is preferable to keep the amount of inevitable impurities at 0.1% by mass or less. In particular, since the effect of titanium, manganese, and zirconium on thermal conductivity is great, it is preferable to suppress this value to 0.05% by mass or less.

(Solution Heat Treatment: 1-10 Hours at 480-540 Degrees Celsius, and Subsequent Quenching)

By conducting solution heat treatment under the abovementioned conditions, segregation at the micro and macro level that can be seen in the cast structure is alleviated and the variability of thermal conductivity and mechanical strength are reduced, the dissolution in solid solution of magnesium-silicon precipitates within the matrix is facilitated, iron and other transition elements that are in supersaturated solid solution are precipitated, and thermal conductivity improves, and further, it is possible to improve plastic workability by spheroidizing the silicon particles to improve extensibility.

If the treatment temperature is less than 480 degrees Celsius, or if the amount of time the treatment is maintained is less than 1 hour, the abovementioned effect is insufficient, and on the other hand, if the treatment temperature exceeds 540 degrees Celsius, or if the amount of time the treatment is maintained exceeds 10 hours, localized melting occurs and the possibility of the strength decreasing becomes greater. In order to obtain more of the effects of solution heat treatment, it is preferable for the treatment temperature to be greater than 500 degrees Celsius. Further, in cases where solution heat treatment is not conducted, it is preferable for cooling to be done after casting at least until 200 degrees Celsius is reached, at a rate of 100 degrees Celsius per second or faster.

(Aging Treatment: 1-10 Hours at 160-270 Degrees Celsius)

By the abovementioned aging treatment, it is possible to improve the thermal conductivity of an alloy by precipitating silicon and magnesium dissolved in solid solution within the matrix as magnesium-silicon compounds, and reducing the amount of silicon and magnesium dissolved in solid solution in the matrix. Additionally, magnesium-silicon compounds improve the mechanical strength of an alloy. If the aging conditions are below 160 degrees Celsius or less than 1 hour, since the amount of magnesium-silicon compounds precipitated is relatively small, the improvement in thermal conductivity is small. On the other hand, if 270 degrees Celsius or 10 hours is exceeded, overaging occurs, and strength is reduced. The conditions for heat treatment may be selected, similarly with the alloy composition, according to characteristics such as thermal conductivity and strength, and further, in consideration of restrictions due to industrial production, but in consideration of the balance between thermal conductivity and strength, it is desirable for the aging treatment to be done for 4-8 hours at 180-250 degrees Celsius.

Herebelow, embodiments of the inventions according to claims 1 through 4 shall be described.

(Embodiment 1)

Alloy casting materials wherein 0, 0.3, 0.5, and 0.6% by mass of magnesium was added to an aluminum alloy containing 7.0% by mass of silicon were prepared, and subsequently, the aging treatments shown in Table 1 were conducted on said casting materials, and thermal conductivity was measured. The measurement results for thermal conductivity are shown together in Table 1. Additionally, for the alloys containing 0 and 0.3% by mass of magnesium, the amount of silicon and magnesium dissolved in solid solution was also measured. The results are shown in Table 2. Casting was done by gravity die casting.

TABLE 1

| | Aging Conditions | | | | | |
|---|---|---|---|---|---|---|
| | No Aging | 8 hrs at 100 deg C. | 8 hours at 180 deg C. | 4 hours at 200 deg C. | 4 hours at 250 deg C. | |
| 0 mass % | 170 | 170 | 170 | 172 | 173 | Comp. Ex. |
| 0.1 mass % | 165 | 166 | 173 | 177 | 180 | Invention Examples |
| 0.3 mass % | 161 | 163 | 171 | 174 | 176 | |
| 0.5 mass % | 157 | 160 | 169 | 171 | 173 | |
| 0.6 mass % | 155 | 159 | 162 | 165 | 171 | Comp. Ex. |

Units of thermal conductivity: $\lambda/w \cdot m^{-1} \cdot k^{-1}$

TABLE 2

| Mg Amount | Aging Conditions | Amount of Si Dissolved in Solid Solution | Amount of Mg Dissolved in Solid Solution | Si + Mg |
|---|---|---|---|---|
| 0 mass % | No Aging | 0.50 mass % | <0.01 mass % | 0.50 mass % |
| | 4 hrs at 200 deg C. | 0.47 mass % | <0.01 mass % | 0.47 mass % |
| 0.3 mass % | No Aging | 0.45 mass % | 0.19 mass % | 0.64 mass % |
| | 4 hrs at 200 deg C. | 0.20 mass % | 0.08 mass % | 0.28 mass % |

According to table 1, in the state where no aging treatment is done, casting material with magnesium added has a lower thermal conductivity than casting material with no magnesium added, but it can be seen that if aging treatment is conducted, the thermal conductivity of casting material with magnesium added has a thermal conductivity equivalent to or greater than that of a casting material with no magnesium added. However, for casting material with 0.6% by mass of magnesium added, the improvement in thermal conductivity is insufficient, and the thermal conductivity is lower than that for casting material with no magnesium added. It is thought that this is because the effect of the reduction in thermal conductivity due to an increase in the amount of magnesium dissolved in solid solution is greater than the improvement in thermal conductivity caused by a reduction in the amount of silicon dissolved in solid solution.

Additionally, table 2 shows that if aging treatment is conducted, the amount of silicon dissolved in solid solution in an alloy whereto magnesium is added becomes lower.

(Embodiment 2)

Casting materials wherein 0 and 0.3% by mass of magnesium are added to an aluminum alloy containing 7.0% by mass of silicon and 0.4% by mass of iron were prepared. The casting materials were cast using the PF die casting method. After conducting solution heat treatment on the obtained casting material for 2 hours at 500 degrees Celsius, water quenching was done. Subsequently, the thermal conductivity was measured, and after this, aging treatment was done for 4 hours at 250 degrees Celsius, and the thermal conductivity was measured again. The results are shown in table 3.

According to table 3, in cases also where iron is contained, in the state wherein aging treatment is not performed on a casting material with magnesium added, the thermal conductivity is lower than casting material with no magnesium added, but it can be seen that if aging treatment is performed, the thermal conductivity improves to an equivalent level or better than a casting material with no magnesium added.

TABLE 3

| | Aging Conditions | | |
|---|---|---|---|
| Mg Amount | No Aging | 4 hrs at 250 deg C. | |
| 0 mass % | 168 | 170 | Comparative Example |
| 0.3 mass % | 158 | 175 | Invention Example |

Units of thermal conductivity: $\lambda/w \cdot m^{-1} \cdot k^{-1}$

The inventions according to claims 5 through 9 of the present application shall be explained.

In preferred embodiments of the present invention, the aluminum alloy casting with excellent thermal conductivity of the present invention contains 6.0-8.0% by mass of silicon, 0.6% by mass or less of any single element other than silicon or aluminum, the amount of silicon in solid solution within the aluminum matrix being adjusted to 0.5-1.1% by mass, and the area ratio of the crystallized products within the metal structure being adjusted to 5-8%.

Here, the abovementioned aluminum alloy casting preferably has a composition comprising, for elements other than silicon and aluminum, 0.2-0.5% by mass of magnesium, 0.6% by mass or less of iron, and other elements with a total amount of 0.2% by mass or less.

Herebelow, the effects of each component and the area ratio of the crystallized products, and the reason for restriction shall be explained.

(Silicon: 6.0-8.0% by Mass)

Silicon has the effect of improving castability. In cases where things having a complex shape or a thin-walled portion such as heatsinks are cast, in order to achieve sufficient castability, it is necessary to make the silicon content 6.0% by mass or more. This silicon crystallizes as silicon based crystallizations, and has the effect of improving the mechanical strength, wear resistance, and vibration damping of the casting. Additionally, the further the silicon content is increased, castability and the like improves, but if the silicon content exceeds 8.0% by mass, the thermal conductivity is reduced. Therefore, for the objective of the present invention, the silicon content must be within the range of 6.0-8.0% by mass.

(Magnesium: 0.2-0.5% by Mass)

Magnesium is not a necessary element for the present invention. However, magnesium forms magnesium based crystallized products, and has the effect of improving mechanical strength, so in cases where mechanical strength is particularly sought, it is preferable that magnesium be contained. This effect becomes marked at 0.2% by mass or greater, and when 0.5% by mass is exceeded, thermal conductivity is reduced. Further, a portion of the magnesium forms magnesium-silicon precipitates, having the effect of improving mechanical strength. Therefore, in cases where magnesium is contained, it is preferable that this is in the range of 0.2-0.5% by mass.

(Iron: 0.6% by Mass or Less)

Iron is an impurity that gets mixed in inevitably, but along with improving mechanical strength, in cases where the die casting method is used, it has the effect of suppressing sticking to the die. However, as the amount of iron increases, thermal conductivity and extensibility are reduced, and if the iron content exceeds 0.6% by mass, plastic workability becomes insufficient. Accordingly, even if iron gets mixed in inevitably, it is preferable to keep the iron content at 0.3% by mass or less.

(Total Amount of Elements Other than Silicon, Aluminum, Magnesium, and Iron)

The aluminum alloy casting of the present invention may contain elements other than silicon, magnesium, iron, and aluminum if their total amount is 0.2% by mass or less. These elements are normally inevitable impurities, but it is not necessary for them to be so considered. Substantially, titanium, manganese, chromium, boron, zirconium, phosphorus, calcium, sodium, strontium, antimony, zinc, and the like may be given as these elements.

Additionally, here, the effect that titanium, manganese, and zirconium have on the thermal conductivity is great, so that it is preferable that their amounts be suppressed to 0.05% by mass or less.

(Amount of Silicon in Solid Solution: 0.5-1.1% by Mass) (Preferable Range: 0.55-1.05% by Mass, More Preferable Range: 0.6-1.0% by Mass)

In the aluminum alloy casting, the amount of silicon in solid solution has a large effect on the thermal conductivity thereof, and if the amount of silicon in solid solution exceeds 1.1% by mass, the thermal conductivity is reduced. On the other hand, if the amount of silicon in solid solution is less than 0.5% by mass, then a sufficient mechanical strength cannot be obtained.

(Area Ratio of Crystallized Products: 5-8%) (Preferable Range: 5.5-7.5%, More Preferable Range: 6.0-7.0%)

The inventors of the present invention have newly discovered that in aluminum alloy castings, when the area ratio of crystallized products exceeds 8%, the crystallized products inhibit thermal conductivity. Additionally, extensibility becomes low. On the other hand, if the area ratio of crystallized products is low at less than 5%, sufficient strength cannot be obtained.

The inventors of the present invention discovered that the abovementioned aluminum alloy is obtainable by further performing heating and holding treatment to a predetermined temperature on a conventional aluminum alloy casting with excellent castability.

That is, in the manufacturing method according to the present invention, first, an aluminum alloy casting material having a predetermined composition is manufactured. For the manufacturing method, an appropriate conventionally known casting method may be used, such as the molten metal casting method, the DC method, the die casting method, and in some cases, commercially available aluminum alloy castings may be used as a material for the method of the present invention. The aluminum alloy casting materials to be used contain 6.0-8.0% by mass of silicon, and 0.6% by mass or less of any single element other than silicon or aluminum, and more preferably contains 6.0-8.0% by mass of silicon, 0.2-0.5% by mass of magnesium, and 0.6% by mass or less of iron, the remainder comprising aluminum and other elements in a total amount of 0.2% by mass or less. As examples of this kind of aluminum alloy casting, castings cast with JIS AC4C and AC4CH alloys may be given.

Next, heating and holding treatment is done to 400-510 degrees Celsius on the abovementioned aluminum alloy casting material. By such a heating and holding treatment, silicon that was in solid solution within the matrix precipitates, and the amount of silicon in solid solution within the matrix becomes in the range of 0.5-1.1% by mass, and concurrently, a portion of the crystallized products dissolves in solid solution in the matrix, and the area ratio of the crystallized products becomes in the range of 5-8%.

Here, if the heating and holding temperature exceeds 510 degrees Celsius, the amount of crystallized products that dissolve in solid solution in the matrix becomes great, and as a result, the area ratio of the crystallized products is reduced, and at the same time, the amount of silicon in solid solution becomes great, so the thermal conductivity is reduced. Additionally, the mechanical strength is also reduced. In contrast, if the heating and holding temperature is 400 degrees or less, the silicon within the matrix does not precipitate, and the amount of silicon in solid solution does not decrease, so the thermal conductivity does not improve. Additionally, a portion of the crystallized products is not dissolved in solid solution in the matrix, so that the area ratio of the crystallized products becomes large, and thermal conductivity is reduced.

Additionally, it is preferable for the heating and holding treatment to be performed for 1 hour or longer. Additionally, even if heating and holding is done for longer than 5 hours, the amount of silicon in solid solution and the area ratio of the crystallized products does not change much further. Therefore, from a cost standpoint, it is preferable that the holding time be less than 5 hours.

After heating and holding, cooling is done to room temperature, but the subsequent cooling can be done by water cooling, or slow cooling can be done by furnace cooling. The amount of precipitates differs according to the cooling rate, and the amount of silicon in solid solution changes, but in the case of the alloy of the present invention, silicon already precipitates during heating and holding treatment, and the amount of silicon in solid solution is small, so its effects are small. In cases where even a small increase in strength is desired, water cooling is preferable. However, in the case of water cooling, the cooling rate will differ for different portions, so deformation can easily occur during cooling, so that for castings having a thin-walled portion such as heatsinks, slow cooling is preferable.

Herebelow, the inventions according to claims 5 through 9 shall be explained in further detail using embodiments.

(Embodiment 3)

An aluminum alloy casting material (corresponding to JIS AC4C) comprising 7.1% by mass of silicon, 0.32% by mass of magnesium, 0.2% by mass of iron, and aluminum, the total content of other elements being 0.2% by mass or below, was cast into 2034×2000 mm by the DC casting method. The obtained as-cast material (No. 1) was maintained at 380 degrees Celsius, 420 degrees Celsius, 450 degrees Celsius, 500 degrees Celsius, 535 degrees Celsius, and 550 degrees Celsius for 5 hours, and subsequently cooled to room temperature by water cooling, and aluminum alloy castings (No. 2-7) were obtained.

Observation of the structure by microscope was done for the as-cast material (No. 1) and the aluminum alloy castings (No. 4-6) obtained by performing heating and holding treatment in the abovementioned manner. A portion of the results are shown in FIG. 1.

Further, regarding each of the abovementioned as-cast material and the aluminum alloy castings, thermal conductivity, tensile strength, amount of silicon in solid solution, and the area ratio of crystallized substances was measured.

Here, regarding the amount of silicon in solid solution, the silicon content of the alloy and the amount of silicon within thermal phenol residue was determined by chemical analysis, and the amount of silicon in solid solution was taken to be the difference when the amount of silicon within the phenol residue was subtracted from the amount of silicon within the obtained alloy. The thermal phenol dissolution residue was recovered by filtering the product with a membrane filter (0.1 μm) after dissolving the alloy with thermal phenol.

Additionally, regarding the area ratio of the crystallized products, after the casting was mirror polished, it was set in an image processing/analysis device, and measured.

Measurement was done by measuring 10 fields of view where 1 field of view was 0.014 square millimeters, and taking the average values.

The results of the above measurements are shown in table 1.

| No. | Heating and Holding Temp. (deg C.) | Amt. of Si in Solid Solution (mass %) | Area Ratio of Crystallized Products (%) | Thermal Conductivity (W/m k) | Tensile Strength (MPa) | Elongation (%) | Note |
|---|---|---|---|---|---|---|---|
| 1 | As-Cast | 0.92 | 10.0* | 159 | 220 | 15 | Cp. Ex. |
| 2 | 380 | 0.48* | 9.8* | 158 | 150 | 17 | Cp. Ex. |
| 3 | 420 | 0.59 | 6.9 | 187 | 163 | 21 | Inv. Ex. |
| 4 | 450 | 0.63 | 6.2 | 184 | 166 | 25 | Inv. Ex. |
| 5 | 500 | 0.98 | 6.8 | 168 | 228 | 24 | Inv. Ex. |
| 6 | 535 | 1.23* | 5.5 | 158 | 249 | 25 | Cp. Ex. |
| 7 | 550 | 1.26* | 5.0 | 153 | 225 | 25 | Cp. Ex. |

*Outside the range of the present invention

As can be seen from the results shown in table 1, as-cast material whereto heating and holding treatment has not been done (No. 1), and comparative aluminum alloy casting (No. 2) wherefor the heating and holding temperature was low, have a large area ratio of crystallized products, and for this reason, thermal conductivity and elongation are low. This confirms that the crystallized products are suppressing thermal conductivity.

Additionally, it can be seen that for comparative aluminum alloy castings (No. 6-7) wherefor the heating and holding temperature is high, the amount of silicon in solid solution increases, and thermal conductivity becomes low.

In comparison, the aluminum alloy castings according to the present invention (No. 3-5), all have values for the amount of silicon in solid solution and the area of crystallized products that are within the optimal range, and it can be seen that the thermal conductivity, tensile strength, and elongation are all high numerical values.

(Embodiment 4)

Heating and holding treatment was done on the as-cast material obtained in embodiment 3 at 450 degrees Celsius for 0.5 hours, 1 hour, 3 hours, and 7 hours respectively, and subsequently slow-cooled to room temperature to obtain aluminum alloy castings (No. 8-11). Regarding the obtained aluminum alloy casting, the amount of silicon in solid solution, the area ratio of the crystallized products, thermal conductivity, tensile strength, and elongation were measured in the same manner as embodiment 3.

The results are shown in table 2.

TABLE 2

| No. | Heating and Holding Time (hr) | Amt. of Si in Solid Solution (mass %) | Area Ratio Crystallized Products (%) | Thermal Conductivity (W/m k) | Tensile Strength (MPa) | Elongation (%) | Note |
|---|---|---|---|---|---|---|---|
| 8 | 0.5 hr* | 0.47* | 8.9* | 156 | 152 | 18 | Cp. Ex. |
| 9 | 1.0 hr | 0.60 | 6.7 | 185 | 165 | 21 | Inv. Ex. |
| 10 | 3.0 hr | 0.62 | 6.6 | 183 | 164 | 23 | Inv. Ex. |
| 11 | 7.0 hr | 0.63 | 6.1 | 184 | 165 | 24 | Inv. Ex. |

*Outside the range of the present invention

As can be seen from the results in table 2, when the time of heating and holding treatment is 0.5 hours, the crystallized products do not sufficiently dissolve in solid solution, and it can be seen that as a result, thermal conductivity, tensile strength, and elongation are reduced.

The invention claimed is:

1. A manufacturing method of an aluminum alloy cast having a thermal conductivity of at least 160 W/(m*K), wherein the amount of Si in solid solution within an aluminum matrix is adjusted to 0.5-1.1% by mass, and an area ratio of crystallized products within a metal structure is adjusted to 5-8%, comprising:

casting a molten aluminum alloy comprising 6.0-8.0% by mass of silicon, 0.2-0.5% by mass of magnesium, 0.6% by mass or less of iron, titanium and/or zirconium in an amount of 0.03% by the mass or less, the remainder consisting of aluminum and 0.2% by mass or less of elements other than silicon, aluminum, magnesium, and iron, heating and holding said cast aluminum alloy cast for 1 hour or longer at 400-450 degrees Celsius, subsequently cooling said cast aluminum alloy cast by furnace cooling.

2. The manufacturing method of an aluminum alloy cast having a thermal conductivity of at least 160 W/(m*K), according to claim 1, wherein an aluminum alloy cast is a heat sink having a complex shape.

3. The manufacturing method of an aluminum alloy cast having a thermal conductivity of at least 160 W/(m*K), according to claim 1, wherein an aluminum alloy cast is a heat sink having a thin-walled portion.

* * * * *